US005296874A

United States Patent [19]

Nagata et al.

[11] Patent Number: 5,296,874

[45] Date of Patent: Mar. 22, 1994

[54] THERMAL PRINTER

[75] Inventors: Atsushi Nagata; Masaaki Orimoto; Yoshiyuki Watanabe, all of Tokyo, Japan

[73] Assignee: Fuji Photo Film Co., Ltd., Kanagawa, Japan

[21] Appl. No.: 778,280

[22] Filed: Oct. 17, 1991

[30] Foreign Application Priority Data

| | | | |
|---|---|---|---|
| Oct. 19, 1990 | [JP] | Japan | 2-282753 |
| Oct. 19, 1990 | [JP] | Japan | 2-282754 |
| Oct. 20, 1990 | [JP] | Japan | 2-282660 |
| Oct. 20, 1990 | [JP] | Japan | 2-282661 |
| Oct. 20, 1990 | [JP] | Japan | 2-282662 |
| Oct. 20, 1990 | [JP] | Japan | 2-282663 |
| Oct. 20, 1990 | [JP] | Japan | 2-282664 |
| Oct. 20, 1990 | [JP] | Japan | 2-282666 |
| Oct. 20, 1990 | [JP] | Japan | 2-282667 |
| Oct. 20, 1990 | [JP] | Japan | 2-282668 |

[51] Int. Cl.[5] ..... B41J 2/325

[52] U.S. Cl. ..... 346/76 PH; 346/138; 400/642; 400/643; 400/644; 400/645; 400/624; 400/629; 400/120

[58] Field of Search ..... 346/76 PH, 138; 400/120, 642, 643, 644, 645, 624, 629; 271/277

[56] References Cited

U.S. PATENT DOCUMENTS

| | | | |
|---|---|---|---|
| 4,912,483 | 3/1990 | Aizawa | 346/76 PH |
| 5,092,698 | 3/1992 | Narui et al. | 271/277 |
| 5,148,187 | 9/1992 | Ono et al. | 346/76 PH |

*Primary Examiner*—Benjamin R. Fuller
*Assistant Examiner*—Huan Tran

[57] ABSTRACT

A thermal printer in which a sheet of recording paper is held by and between a thermal print head includes a plurality of heat generating elements and a platen drum, the amounts of heat of the heat generating elements are selectively changed, and an image is printed onto the recording paper. In the thermal printer, a printing position is set just behind a clamp position at which a clamp clamps the leading end of the recording paper onto the platen drum. Therefore, the image printing can be started immediately after the clamp position passes through the thermal head, with the recording paper being in part wound around the platen drum by the thermal printer. As a result, the time taken from paper feeding to printing starting can be reduced.

15 Claims, 14 Drawing Sheets

THERMAL PRINTER

BACKGROUND OF THE INVENTION

1. Field of the Invention

The present invention relates to a thermal printer and, in particular, to a thermal printer in which recording paper is held by and between a thermal print head including a plurality of heating elements and a platen drum, the quantity of heat of the heating elements is selectively changed while carrying the recording paper, and an image is recorded on to the recording paper.

2. Description of the Related Art

A thermal printer has been conventionally used as a printer of a medical image diagnostic system in a medical treatment field. In other words, in the medical treatment field, there are available various kinds of medical image diagnostic appliances such as an ultrasonic image projector, an X ray CT and the like which apply ultrasonic waves, X rays or the like to a patient to detect the change of the ultrasonic waves, X rays or the like to thereby obtain an image of the affected part of the patient, and displays the image, for example, on a CRT monitor as a visual image.

In the above-mentioned medical image diagnostic appliances, it is convenient if the image of the affected part to be displayed on the monitor can be provided in the form of a hard copy. For this purpose, there have been developed various kinds of printers including a thermal printer.

Also, besides the medical use, the thermal printer has been applied to the surface printing of an ID card, a prepaid card and the like.

As the thermal printer, there are known a heat transfer type thermal printer and a heat sensitive thermal printer. Here, referring to a thermal printer of a heat transfer type with reference to FIG. 17, for example, recording paper 2 is fed one by one from a paper feed cassette 1. A platen drum 6 clamps the leading end of the recording paper by a clamper 7 and is then rotated almost half way round to a printing part. In the printing part, there are disposed a thermal print head 4 including a plurality of heating elements 3 and an ink sheet cassette 5. The thermal print head 4 and the platen drum 6 cooperate in holding the ink sheet and the recording paper 2 fed between them. In this holding condition, the heating elements 3 are driven in accordance with an image signal supplied from a control device to thereby transfer the image from the ink sheet to the recording paper 2. In order to obtain a color image, areas Y, M and C are sequentially formed in the ink sheet, and to which areas three kinds of ink, that is, yellow (Y), magenta (M) and cyan (C) referred to as subtractive primaries for printing are attached. The R, G and B signals of a color image are respectively converted to YMC signals and are then applied to the thermal head 4, so that the three-color printing can be achieved.

After completion of the printing, the platen drum 6 is rotated reversely and the printing paper is passed through a paper discharge passage 8 and is inserted into a paper discharge tray 9 with the following end of the paper entering first.

In the above-mentioned conventional thermal printer, however, due to the fact that the platen drum 6 is rotated almost half way around and is positioned at the printing part after the the recording paper 2 is clamped by the clamper 7, it takes a long time from the paper feeding to the start of the printing.

Also, in the conventional thermal printer, after completion of the printing, in order to prevent mutual interference between the recording paper 2 and the ink sheet cassette 5, or to set the following end of the recording paper at the entrance of the paper discharge passage 8, the platen drum 6 is rotated at a given angle in the same direction as in the printing time and is then rotated reversely to thereby discharge the recording paper. This results in a long printing time.

Further, according to the conventional thermal printer, an exit of the paper discharge passage 8 is opened up in a paper guide wall around the platen drum 6 and thus the paper guide wall is cut off in this portion. For this reason, when the recording paper 2 is clamped and rotated by the platen drum 6 and is passed through an opening formed in a paper feed/discharge passage 8, the recording paper 2 is caused to jump up at the edge of the opening due to its rigidness or hardness, and this jumping problem adversely effects the printing producing a slit mark.

Moreover, according to the conventional thermal printer, in order to guide the recording paper 2 around the platen drum 6, several auxiliary rollers are pressed against the platen drum 6 or a wall-shaped paper guide member is used. However, the wall-shaped paper guide member is divided into several portions because of the necessity of the paper feed/discharge opening and due to the forming limitations, and the connecting parts of the divided portions are joined with one another in a smooth manner.

For this reason, the following end of the recording paper 2 is caused to jump up at the stepped portions and clearances between the connecting portions of the paper guide member to thereby produce load variations. The load variations adversely effects the printing.

In addition, in the conventional thermal printer, the thermal print head 4 includes a plurality of heat sensitive elements arranged in a direction perpendicular to the carrying direction of the recording paper 2, and a voltage is applied based on an image signal to thereby drive the heat sensitive elements so as to be able to transfer a desired image from the ink sheet to the recording paper 2. Such a thermal print head is mounted at the two ends thereof to a arms. The thermal printer head 4 is disposed so that it oscillates pair of oscillatory arms, with respect to the platen 5 drum 6; and so that the thermal print head 4 may be brought into contact with the platen drum 6 when printing. A spring is mounted to each of the oscillatory arms and the springs press the thermal print head 4 against the platen head when the thermal print head 4 is in contact with the platen head.

However, in the conventional thermal printer, the pair of springs may sometimes have different spring forces from each other. Therefore, an even pressure cannot be applied to the platen drum 6, and an uneven pressure during printing may be produced.

SUMMARY OF THE INVENTION

The present invention is directed towards eliminating the drawbacks found in the above-mentioned conventional thermal printer.

Accordingly, it is an object of the invention to provide a thermal printer which is capable of reducing a time to be taken from paper feeding to print starting.

In order to achieve the above object, according to one embodiment of the invention, there is provided a thermal printer comprising: a recording paper storage part for storing a plurality of sheets of recording paper respectively cut to a given length and piled on one another; a recording paper feeding part for drawing out the recording paper sheet by sheet; a platen drum for holding the leading end of the recording paper drawn out by the recording paper feeding part and winding the recording paper around the peripheral surface thereof; a thermal print head for printing an image on to the recording paper on the platen drum while rotating the platen drum; and a recording paper discharge tray part, when the platen drum is rotated again after completion of the printing, for receiving the recorded paper carried by the rotating platen drum, wherein a holding position on the platen drum holds to the recording paper fed from the recording paper storage part and is set just before a portion in which the thermal print head prints.

According to the embodiment of the invention, the leading end of the recording paper is held on the platen drum and, when the paper holding position passes the thermal print head, printing is started immediately, with the recording paper partially around. This can reduce a time to be taken from paper feeding to print starting.

Also, it is another object of the invention to provide a thermal printer which is capable of rotating a platen drum reversely to discharge a sheet of recorded paper immediately after completion of printing.

In order to attain this object, according to another embodiment of the invention, there is provided a thermal printer which comprising: a recording paper storage part for storing a plurality of sheets of recording paper respectively cut to a given length and piled on one another; a recording paper feeding part for drawing out the recording paper sheet by sheet from the recording paper storage part; a platen drum for holding the leading end of the recording paper drawn out by the recording paper feeding part and winding the recording paper around the peripheral surface thereof; a thermal print head for printing an image onto the recording paper on the platen drum while rotating the platen drum; and, a paper discharge tray part for receiving, when the platen drum is rotated reversely after completion of the printing, the recorded paper carried by the reversely rotating platen drum with the following end of the recorded paper entering first, rotary paper guide means is provided which is used to guide the following end of the recorded paper at the time of completion of the printing, According to this embodiment of the invention, during the printing, the rotary paper guide means is retreated from an ink sheet cassette. Immediately when the printing is finished, the platen drum is rotated in a reverse direction. In this operation, the rotary paper guide means is rotated and part of the rotary paper guide means is located at the position of the ink sheet cassette, whereby the following end of the recorded paper is guided to a paper discharge passage to prevent the recorded paper from interfering with the ink sheet cassette. This prevents the platen drum from rotating more than enough so that a printing time can be reduced.

It is a further object of the invention to provide a thermal printer which can prevent the recording paper from jumping up in an opening formed in a paper feed/-discharge passage, around a platen drum.

In order to further embodiment accomplish this object, according to the invention, there is provided a thermal printer comprising: a recording paper storage part for storing a plurality of sheets of paper respectively cut to a given length and piled on one another; a recording paper feeding part for drawing out the recording paper sheet by sheet from the recording paper storage part; a platen drum for holding the leading end of the recording paper drawn out by the recording paper feeding part and winding the recording paper around the peripheral surface thereof; a thermal print head for printing an image onto the recording paper on the platen drum while rotating the platen drum; and a recording paper discharge tray part for receiving when the platen drum is rotated again after completion of the printing, the recorded paper carried by the rotating platen drum, wherein an oscillatory piece member is provided in an opening formed in the recording paper feed/discharge passage and faces toward a paper guide around the platen drum in such manner that the oscillatory piece member is free to oscillate and will never close the opening, and also, when the recording paper is carried by the platen drum, the oscillatory piece member closes the opening in the paper feed/discharge passage and guides the recording paper.

According to this embodiment of the invention, the recording paper is clamped on the platen drum and in this condition the paper is guided by the paper guide, that is, the paper is rotated around the platen drum. When the recording paper arrives at the opening in the paper feed/discharge passage, then the recording paper pushes up the oscillatory piece member so that the oscillatory piece member closes the opening. The following end of the recording paper is guided by this oscillatory piece member and is moved smoothly through the opening in the paper feed/discharge passage.

It is a still further object of the invention to provide a thermal printer which enables the following end of the recording paper to be smoothly guided in the connecting portion of a paper guide around the platen drum.

In order to another embodiment of achieve the above object, according to theinvention, there is provided a thermal printer comprising: a recording paper storage part for storing a plurality of sheets of recording paper respectively cut to a given length and piled on one another; a recording paper feeding part for drawing the recording paper sheet by sheet from the recording paper storage part; a platen drum for winding the recording paper drawn out by the recording paper feeding part around the peripheral surface thereof; a thermal print head for printing an image onto the recording paper on the platen drum while rotating the platen drum; and a paper discharge tray part for receiving, when the platen drum is rotated again after completion of the printing, the recorded paper carried by the platen drum, wherein a plurality of paper guides are provided along the periphery of a platen at a given distance from the platen drum, and also, in at least one set of the connecting portions of the respective paper guides, the end thereof on the leading side in the recording paper carrying direction is positioned nearer to the platen drum than the end thereof on the following side in the recording paper carrying direction, According to the embodiment of the invention due to the fact that, in the connecting portions of the paper guides, the end thereof on the leading side in the carrying direction is positioned nearer to the platen drum than the end thereof on the following side in the carrying direction, there is eliminated the possibility that the loads applied to the recording paper can be changed suddenly in the connecting portions of the paper guides, for thereby preventing deterioration of images printed.

It is a yet further object of the invention to provide a thermal printer which can provide an even thermal print head pressure.

In attaining this object, according to this further embodiment of the invention, there is provided a thermal printer comprising a thermal print head for printing an image on recording paper on a platen drum while rotating the platen drum, in which the two ends of the thermal print head are pressurized and energized by springs when they are abutted against the platen drum, and each of the springs is supported by the two ends of a seesaw member which oscillates about the central portion thereof, to thereby be able to cancel a difference in force between the respective springs.

According to the invention, a pair of springs for energizing the thermal print head are supported on the two sides of the seesaw member. For this reason, even if the pair of spring have different springs forces from each other, the spring forces can be made equal to each other by inclining the seesaw member, so that the thermal print head can be pressed against the platen drum with a uniform pressure.

BRIEF DESCRIPTION OF THE DRAWINGS

The exact nature of this invention, as well as other objects, features and advantages thereof, will be readily apparent from consideration of the following specification relating to the accompanying drawings, in which like reference characters designate the same or similar parts throughout the figures thereof and wherein:

FIG. 2 is a view to embodiments of show how an image is initially printed;

DESCRIPTION OF THE PREFERRED EMBODIMENT

Detailed descriptions will hereunder be given of the the preferred embodiments of a thermal printer according to the present invention with reference to the accompanying drawings.

Figure 1:
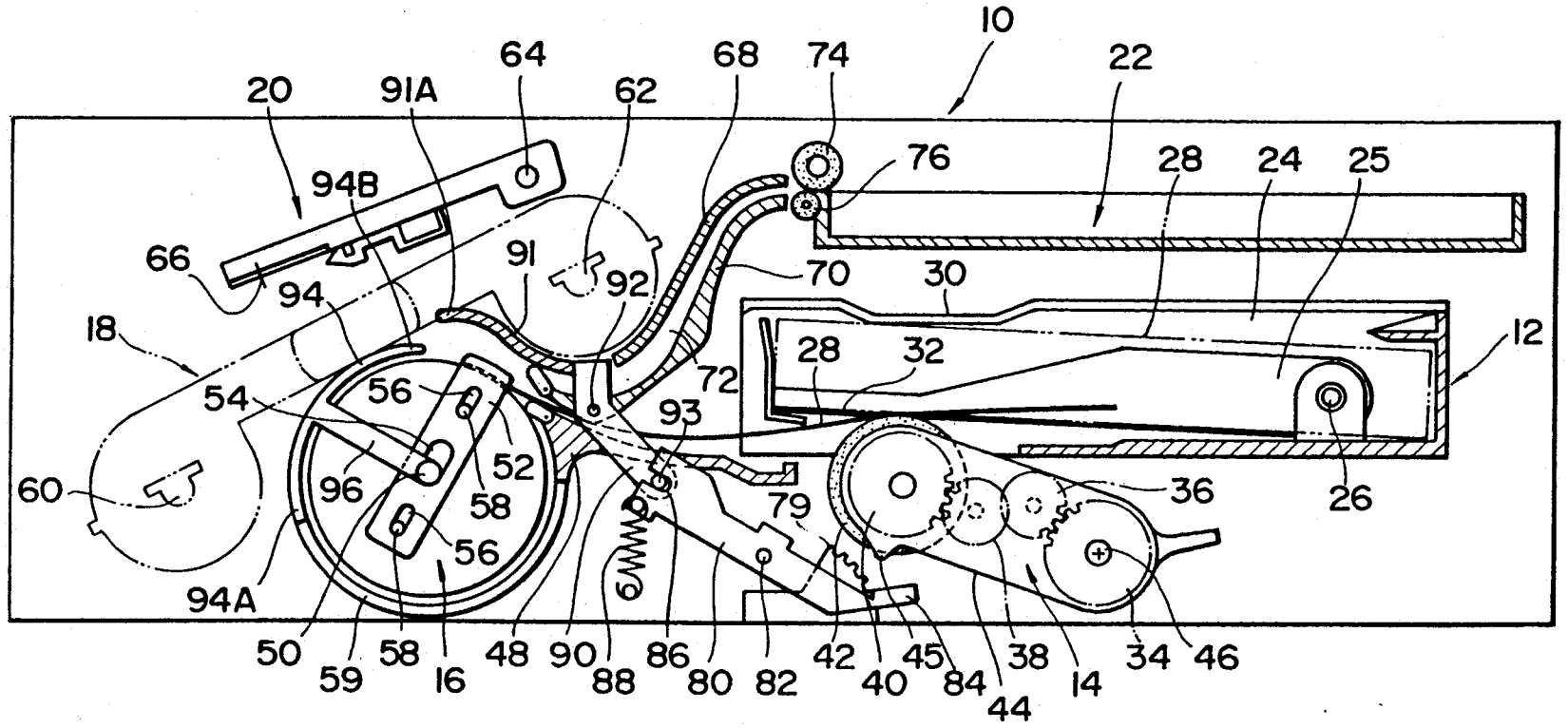
FIG. 1 is a view of the structure of a thermal printer according to the invention, showing how paper is fed.

Referring now to FIG. 1, there is shown a view of the structure of a thermal printer according to an embodiment of the invention. The thermal printer 10 of the invention consists mainly of a recording paper storage part 12, a recording paper feed part 14, a platen drum 16, an ink sheet cassette 18, a thermal print head 20, and a paper discharge tray part 22.

Describing first the recording paper storage part 12, there is disposed a paper feed tray 24 within the recording paper storage part 12 and there is supported a recording paper peel-off member 25 within the storage part 12 in such a manner that the recording paper peel of member 25 is free to oscillate about a shaft 26. Within the paper feed tray 24, there are stored a plurality of sheets of cut paper 28 in such a manner that they are piled on one another. A receiving member 30 is disposed above the paper 28. Also, the cut paper feed tray 24 includes a feed-out opening 32 in the lower portion thereof.

Next, the recording paper feed part 14 includes gears 34, 36, 38 and 40 which intermesh with one another to thereby form a gear transmission mechanism. A paper feed roller 42 consisting of a rubber roller is disposed coaxially with the last gear 40. As shown in detail in a plan view in FIG. 6, these gears 34 to 40 are respectively supported by an oscillating arm unit means 44 which of a pair of arms. The oscillating arm unit is supported by a shaft 46 and holds the paper feed roller 42 from both sides thereof. A gear 41, which is constructed as a free gear, is movable in an axial direction with respect to a shaft 37 and is also pressed against the gear 40 coaxial therewith by a spring 39. The gears 40 and 41 are given a rotational force by friction and, if a braking force of a given force or greater is applied thereto, then the two gears are idly rotated to function as torque, limiters, for thereby preventing the gears from engaging with other too tightly. The oscillating arm unit 44 can be oscillated about a shaft 46 and, with the oscillation of the oscillating arm unit 44, the paper feed roller 42 is allowed in a paper feed mode to be situated in the feed-out opening 32 of the paper feed tray 24 to feed out the recording paper 28 sheet by sheet. As will be discussed later, in other modes than the paper feed mode, the paper feed roller 42 is moved away from the paper feed tray 24 and is thus prevented from feeding out the recording paper 28 carelessly when an image is to be printed.

Figure 6:
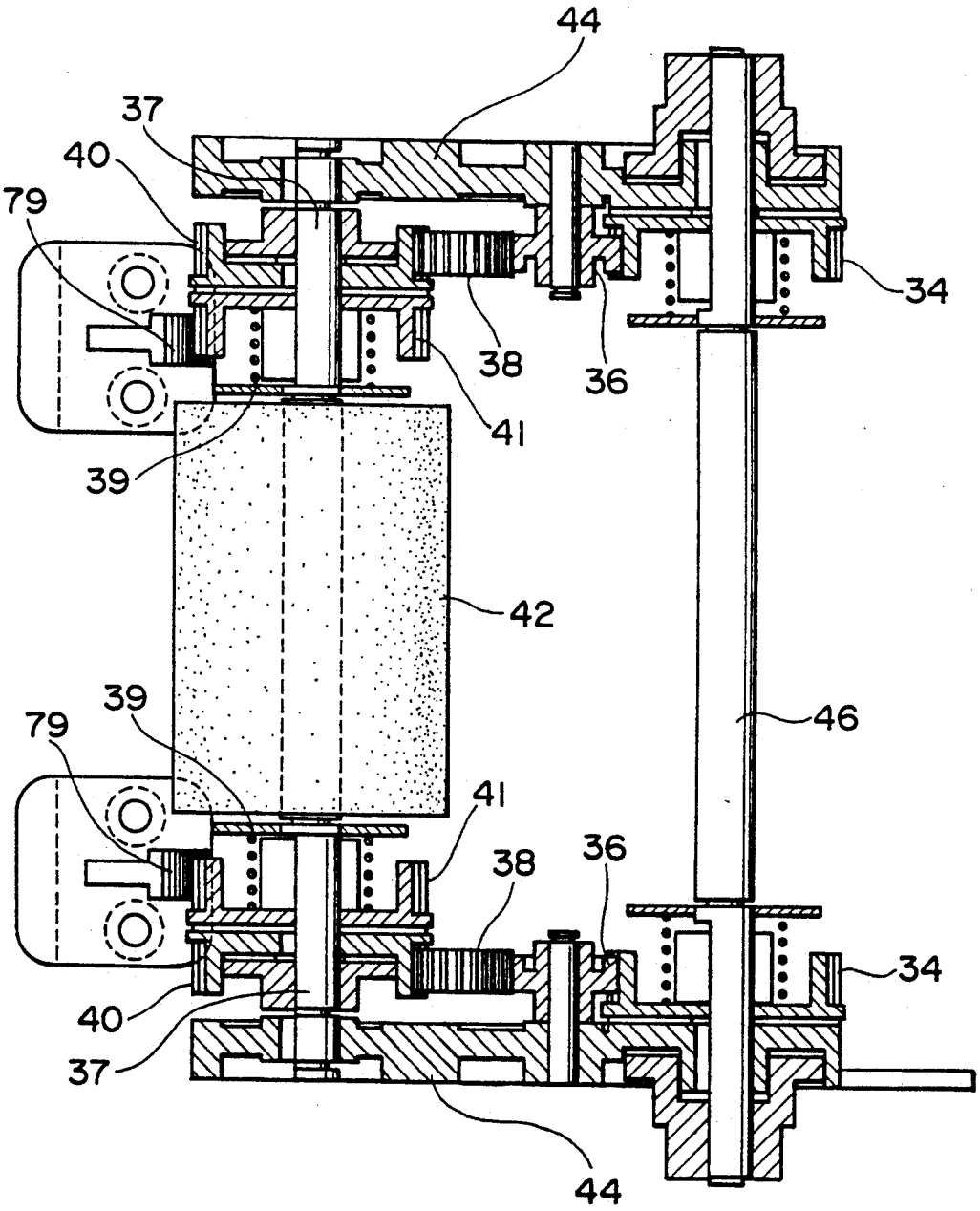
FIG. 6 is a plan view of a recording paper feeding part employed in an embodiment of the invention.

In other words, as shown in FIG. 6, stationary arc gears 79, 79, which are respectively meshable with the gear 41 coaxial with the gear 40, are allowed in other modes than the paper feed mode to mesh with the gear 41 to thereby prevent the oscillating arm unit 44 from oscillating. The recording paper 28, which is fed out by the paper feed roller 42, is guided by a fixed paper guide 48 and is then sent to the platen drum 16 which will be described below.

Figure 7:
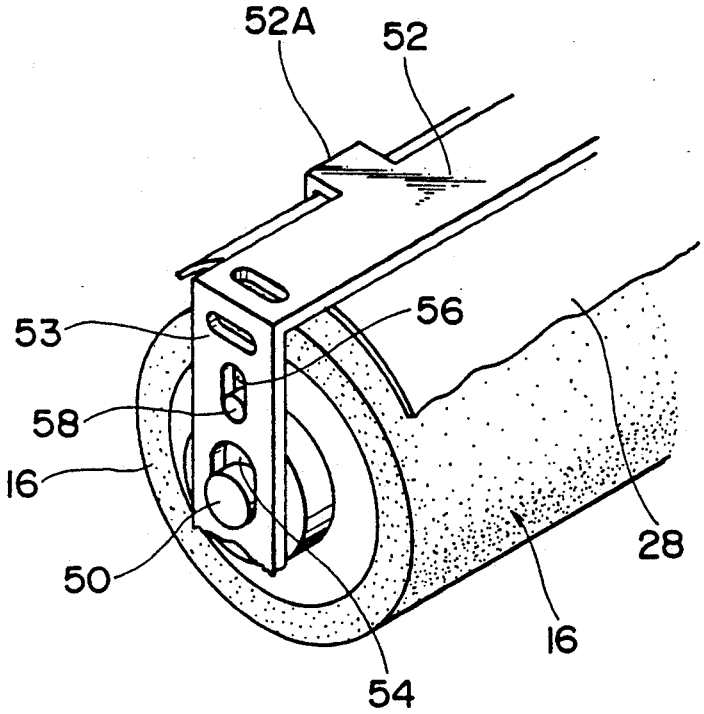
FIG. 7 is a perspective view of a clamper of a platen drum employed in an embodiment of the invention.

The platen drum 16 is constructed in such a manner that it can be rotated about a shaft 50. The platen drum 16 includes a clamper 52 on the peripheral surface thereof. As shown in part in FIG. 7, the clamper 52 includes a side plate 53 and the side plate 53 is constructed such that it can be guided by means of elongated holes 54, 56, 56 and thus can be moved in the diametrical direction of the platen drum 16. That is, the shaft 50 is fitted into the elongated hole 54 and pins 58 (only one pin is shown in FIG. 7) are respectively fitted into the elongated holes 56 (only one hole is shown in FIG. 7), whereby the clamper 52 can be moved in the diametrical direction of the platen drum 16. As shown in detail in FIG. 7, the clamper 52 receives the leading end of the recording paper 28 by a stopper 52A and moves down in the diametrical direction of the platen drum 16 to thereby be able to clamp the leading end of the recording paper 28. However, the clamping device is not limited to the clamper shown in FIG. 7, but a pressure roller or an air suction member can also be used. The platen drum 16 includes in the lower half periphery thereof a fixed paper guide 59 constructed in the form of a semi-circular shape. The paper guide 59 is used to guide the recording paper 28 to the peripheral surface of the platen drum 16.

Above the platen drum 16, there is disposed the ink sheet cassette 18 in an inclined manner. The ink sheet cassette 18 includes a take-up shaft 60 and a supply shaft 62. In one printing, three regions Y, M, C to which three different kinds of ink, that is, yellow (Y), magenta (M), cyan (C), namely, three primary colors.

In particular, at first, responsive to a yellow signal (Y) input to the thermal print head 20, transfer by the yellow region the ink sheet is executed by rotation of the platen drum 16.

Next, by rotation of the platen drum 16, the recording paper 28 is set in such a manner that the ink can be superimposed and transferred again onto the portion in which the yellow image has been formed.

After then, an image signal corresponding to the magenta (M) component is sent to the thermal print head 20. At this time, the ink sheet is moved in such a manner that the next magenta region M comes into contact with the recording paper 28 and, therefore, a magenta image is superimposed and formed by the magenta ink onto the yellow image.

Further, in a similar way, the recording paper 28 is rotated so that the ink can be superimposed and transferred onto the portion in which the images have been formed with the yellow and magenta ink. In this turn, a signal corresponding to a cyan (C) image is input to the thermal print head 20 and the ink sheet is moved such that the next cyan region C comes into contact with the recording paper 28, with the result that an image corresponding to the cyan signal can be formed and superimposed with the cyan ink.

In this way, the yellow, magenta and cyan image signals are input to the thermal print head 20, and the Yellow Y, magenta M and cyan C inks of the ink sheet are superimposed on the same portion of the recording paper 28 to thereby provide a color image.

Now, above the ink sheet cassette 18, there is disposed the thermal print head 20 in such a manner that it is free to oscillate about a shaft 64. The thermal head 20 includes a plurality of heat sensitive elements 66 respectively arranged in a direction perpendicular to the conveying direction of the recording paper 28. The thermal print head 20 applies a voltage to the heat sensitive elements 66 in accordance with the image signals to drive the heat sensitive elements 66 to thereby transfer a desired image from the ink sheet to the recording paper 28.

The printing position of the thermal print head 20 is set just behind the clamping position of the clamper 52. After printing if the platen drum 16 is rotated reversely, then the printed paper 28 is delivered to the paper discharge tray part 22 through a paper discharge passage 72 which is formed by fixed paper guides 68 and 70. In other words, after the printed or recorded paper 28 is sent to the paper discharge passage 72 by the reversed rotation of the platen drum 16, if the trailing end of the paper 28 is held by paper discharge rollers 74, 76, then the leading end of the recorded paper 28 is released from the clamper 52, whereby the recorded paper 28 can be fed by the paper discharge rollers 74, 76 and can be stored within the paper discharge tray part 22.

Figure 4:
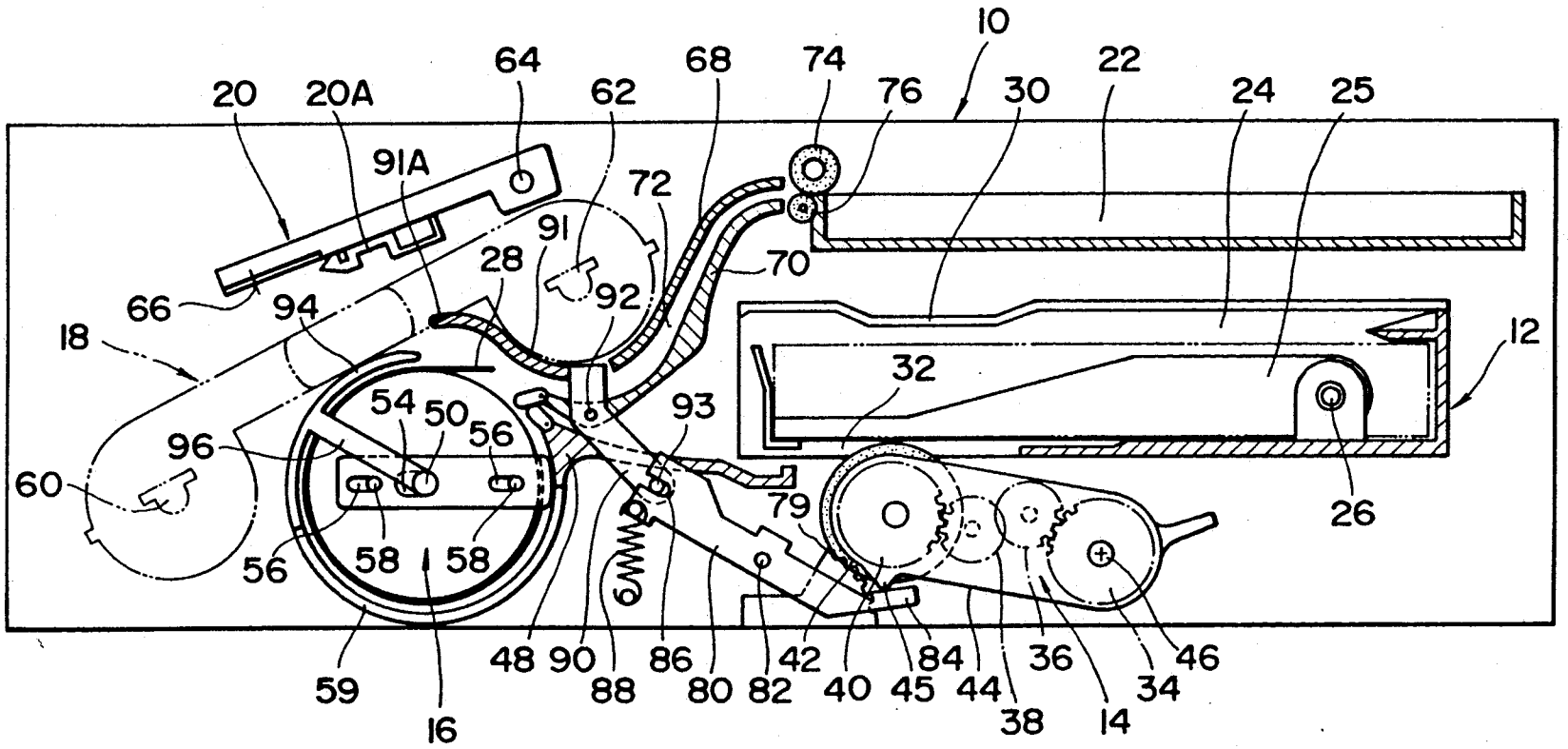
FIG. 4 is a view to show the first half part of the paper discharge process.
Figure 5:
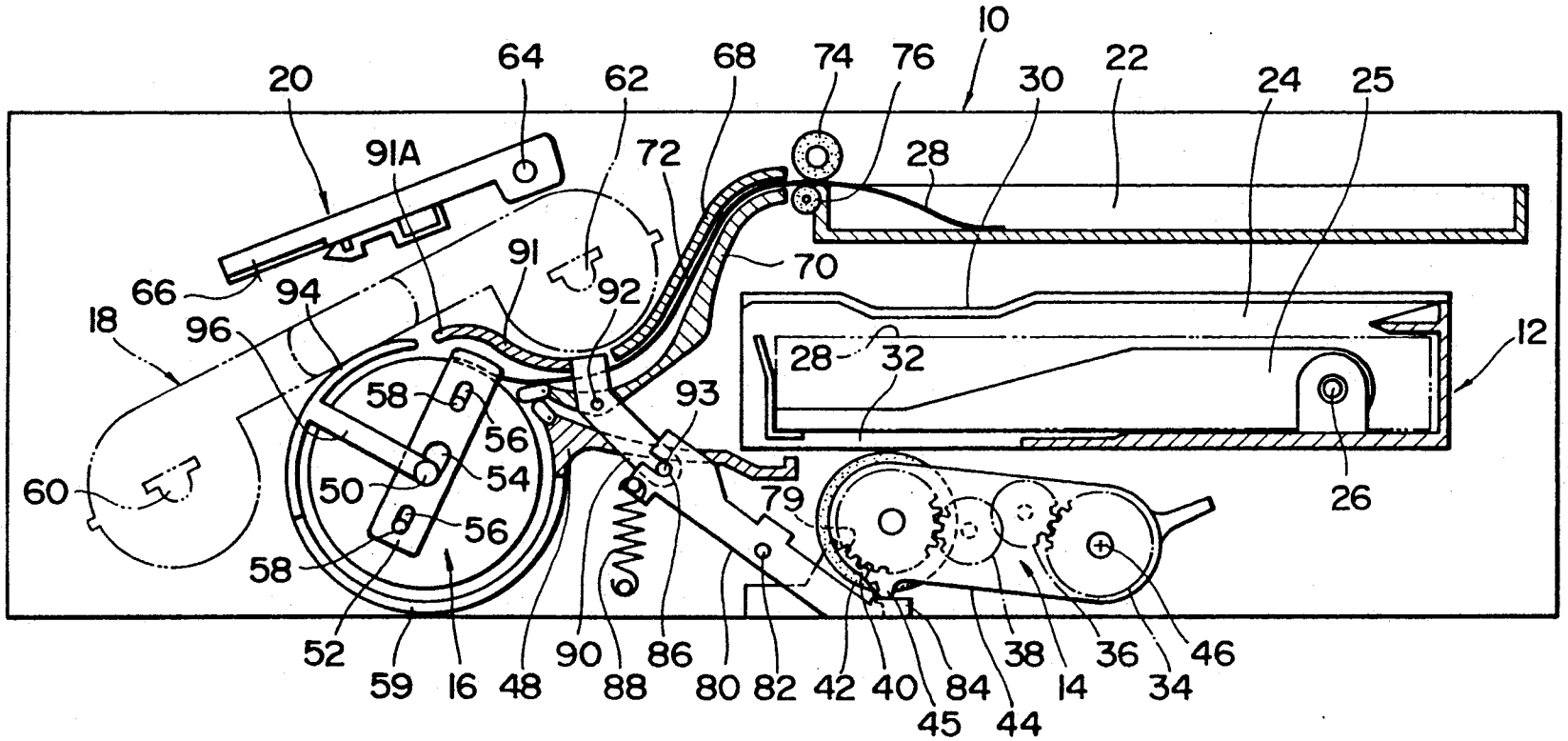
FIG. 5 is a view to show the second half part of the paper discharge process.

Next, a description will be given below of a movable paper guide mechanism. A drive lever 80 is constructed such that it can be freely oscillated about a shaft 82, and the drive lever 80 includes a flat portion 84 in the right end portion thereof and a forked portion 86 in the left end portion thereof. The drive lever 80 is rotationally energized counter clockwise about the shaft 82 by a spring 88. On the other hand, a movable lever 90 is constructed such that it can be freely oscillated about a shaft 92, and the movable lever 90 includes a movable paper guide 91 in the upper end portion thereof and a pin 93 in the lower end portion thereof, with the pin 93 being in engagement with a U-shaped groove formed in the forked portion 86. The movable lever 90 is rotationally energized clockwise about the shaft 92 by the spring 88. When a projection portion 45 provided in the oscillating arm unit 44 is not in contact with the flat portion 84 of the drive lever 80, then the leading end 91A of the movable guide 91 is inserted into the ink sheet cassette 18 (see FIG. 1 and FIG. 4).

Figure 8:
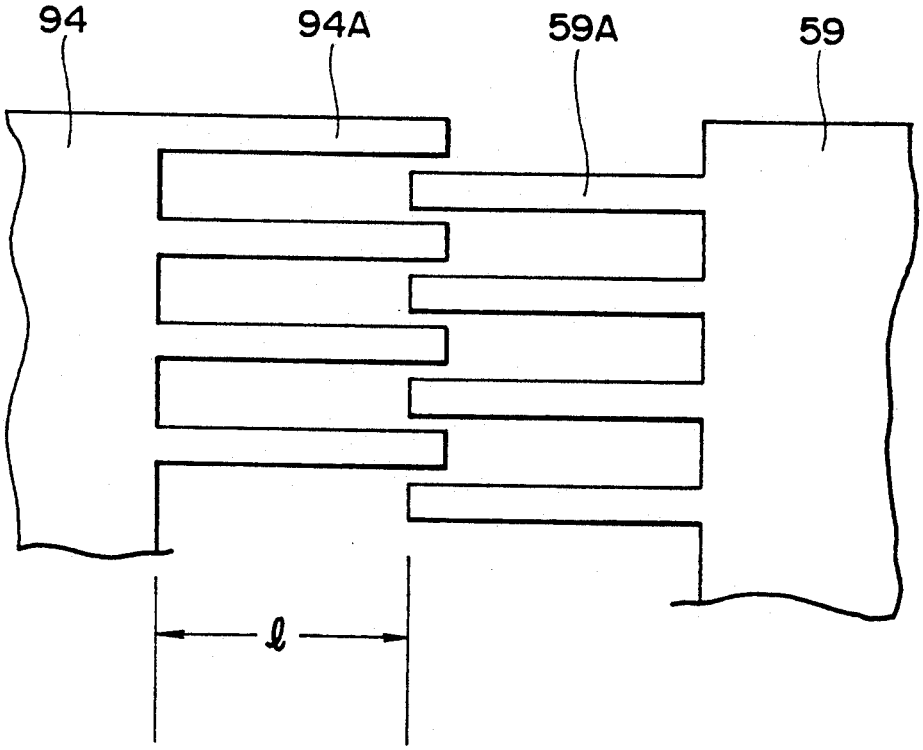
FIG. 8 is an explanatory view of an intersecting portion between, a fixed paper guide and a rotary paper guide around a platen.

Next, a description will be given below of a rotary paper guide mechanism. A rotary paper guide 94 is supported through a pair of arms 96 by a shaft 50 of the platen drum 16 in such a manner that the rotating paper guide 94 can be rotated about the shaft 50. The rotary paper guide 94 is formed as an arc shape extending along the outer periphery of the platen drum 16 and includes an end portion 94A which is located near to the fixed paper guide 59 in such a manner that the end portion 94A and the end portion 59A of the fixed paper guide 59 can intersect each other. As shown in FIG. 8, the rotary paper guide 94 can be rotated only by a distance designated by l. Also, the rotary paper guide 94 can be rotated about the platen drum 16 by a drive mechanism (not shown) according to the paper feed states, printing states and paper discharge states (see FIGS. 1 to 5).

Figure 9B:
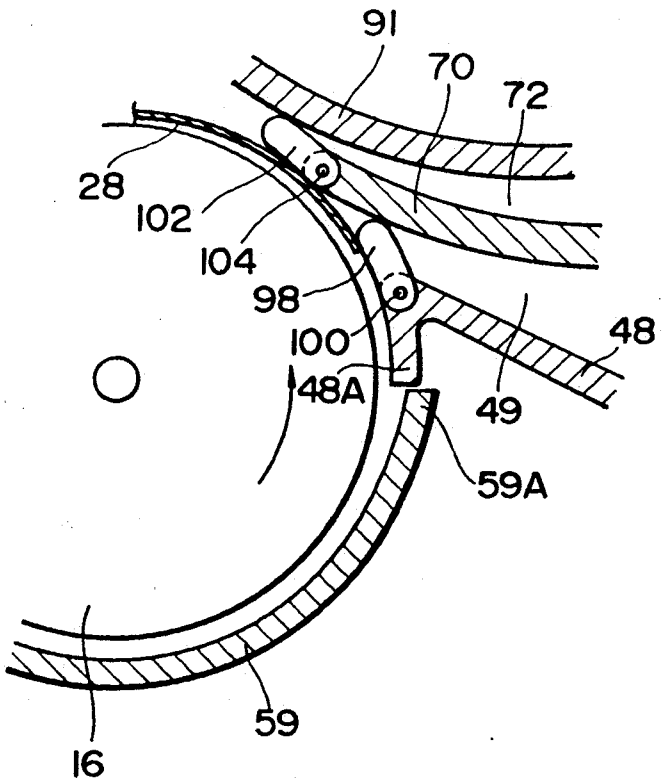
FIGS. 9 (A) and (B) are respectively section views of a paper feed passage and a paper discharge passage around a platen.
Figure 9A:
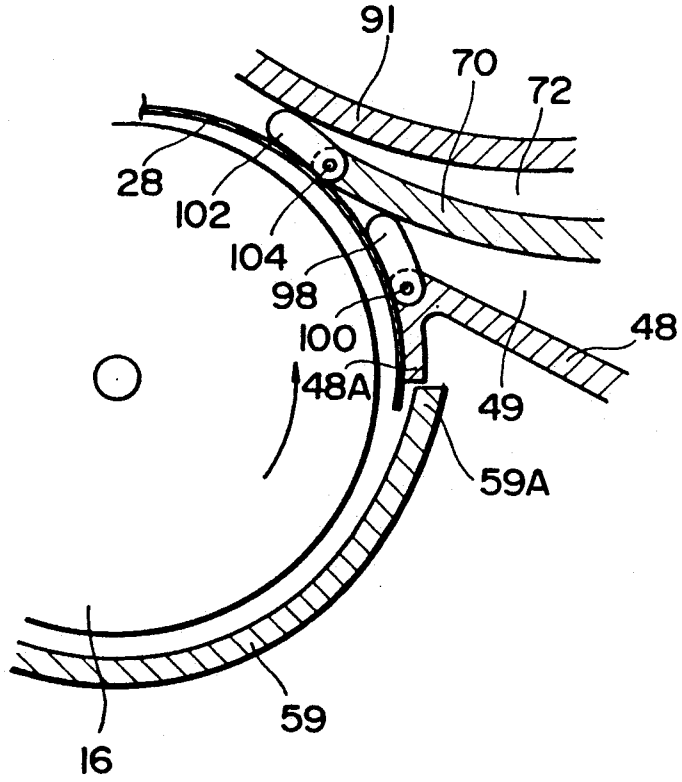

Referring now to FIGS. 9 (A) and (B), there is shown a structure in the neighborhood of the paper feed and discharge passages located round the platen drum 16. There is provided a paper feed passage 49 which is interposed between the paper guide 48 and paper the guide 70. Also, a paper discharge passage 72 is also interposed between the paper guide 70 and the movable paper guide 91. The paper feed passage 49 includes an opening in which an oscillatory piece member 98 is supported through a shaft 100. Also, the paper discharge passage 72 includes an opening in which another oscillatory piece member 102 is supported through a shaft 104. The two oscillatory piece members 98, 102 are supported or journaled in a free state and can be easily oscillated by the leading or trailing end of the recording paper 28.

Preferably, the sliding contact surface of the oscillatory piece member 98 may have such a shape that can match the curved surfaces of the other paper guides 59, 91.

In the above-mentioned embodiment, the oscillatory piece members are provided on both of the paper feed and discharge passages 49, 72. Alternatively, however, they may be provided in one of the feed or discharge passages 49, 72.

The detailed structure of the fixed paper guide 59 is shown in FIGS. 9 (A), (B). In a connecting portion between the paper guides 59 and 48, the end portion 48A of the paper guide 48 located forwardly in the recording paper conveying direction comes nearer to the platen drum than the end portion 59A of the paper guide 59 located rearwardly in the recording paper conveying direction. For this reason, in the neighborhood of the connecting portion between the paper guides 48 and 59, as shown in FIG. 9 (A), the trailing end of the recording paper 28 is guided by the end portion 48A of the paper guide 48, and is free from the influences of the connecting portion between the paper guides 59 and 48, so that the trailing end of the recording paper 28 can be moved apart from the paper guide 59 smoothly.

Figure 10:
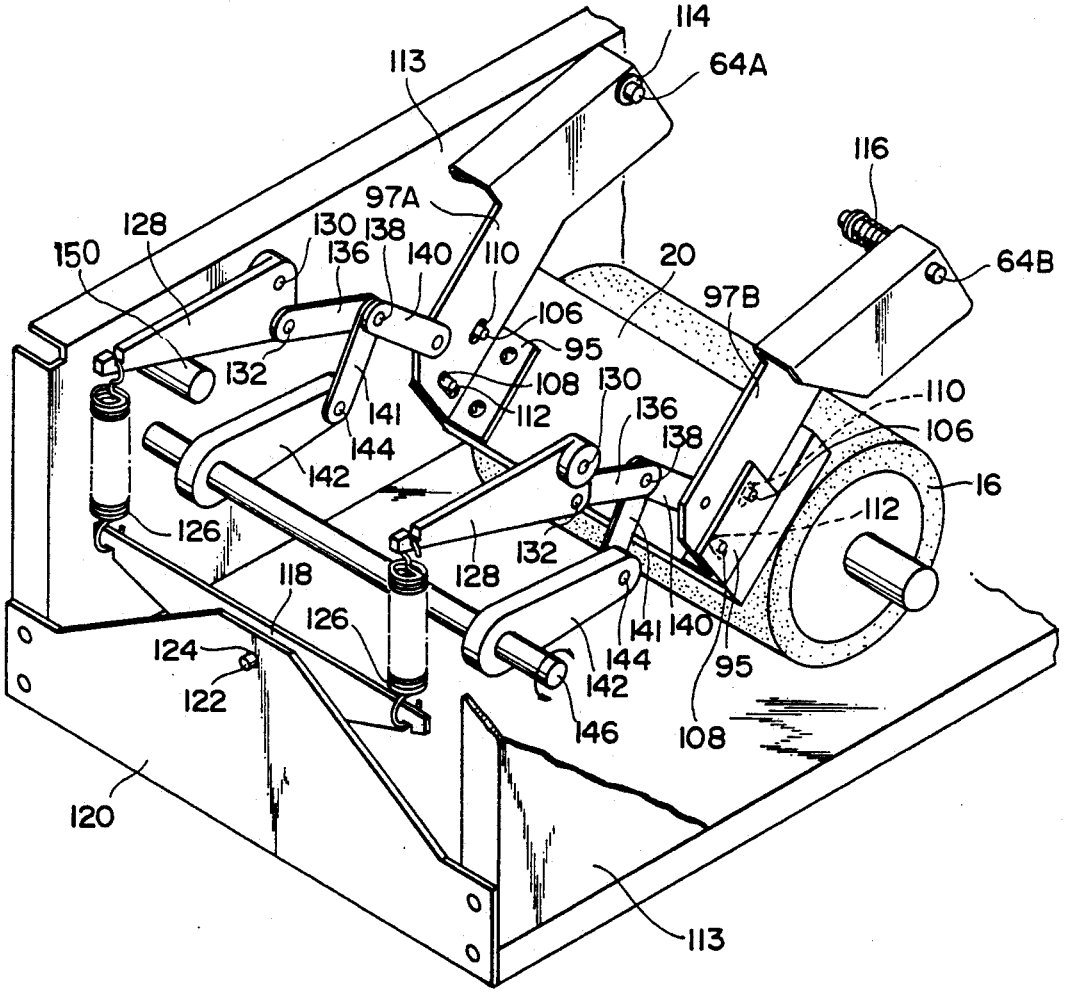
FIG. 10 is a perspective view of a structure for mounting a thermal print head.

As shown in FIG. 10, the thermal print head 20 is mounted through L-shaped brackets 95 to the tip ends of oscillatory arms 97A, 97B. The L-shaped brackets 95 include pins 106, 108 which are respectively projecting towards the oscillatory arms 97A, 97B from the brackets. The pin 106 is loosely fitted into a transversely elongated hole 110 formed in the oscillatory arms 97A, 97B, while the pin 108 is loosely fitted into a longitudinally elongated hole 112. For these reasons, the mounting portion of the thermal print head 20 has a freedom of movement so that the thermal can follow the inclining movement of the platen drum 16.

Figure 11:
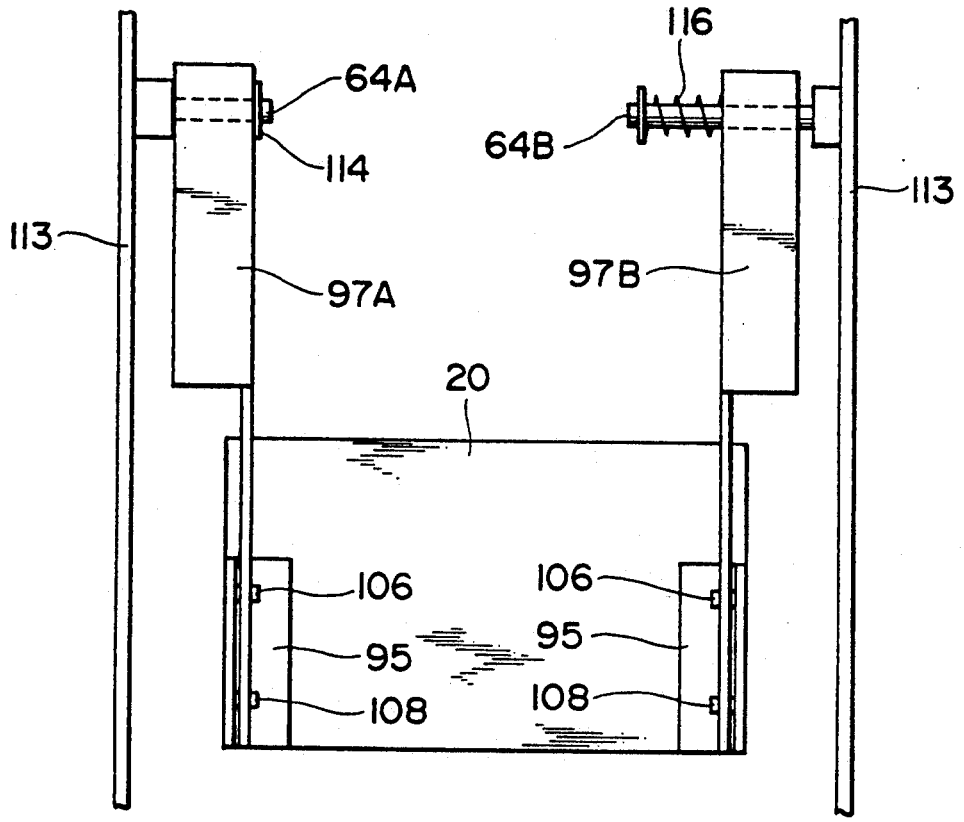
FIG. 11 is a plan view of a structure for mounting a thermal print head.
Figure 12:
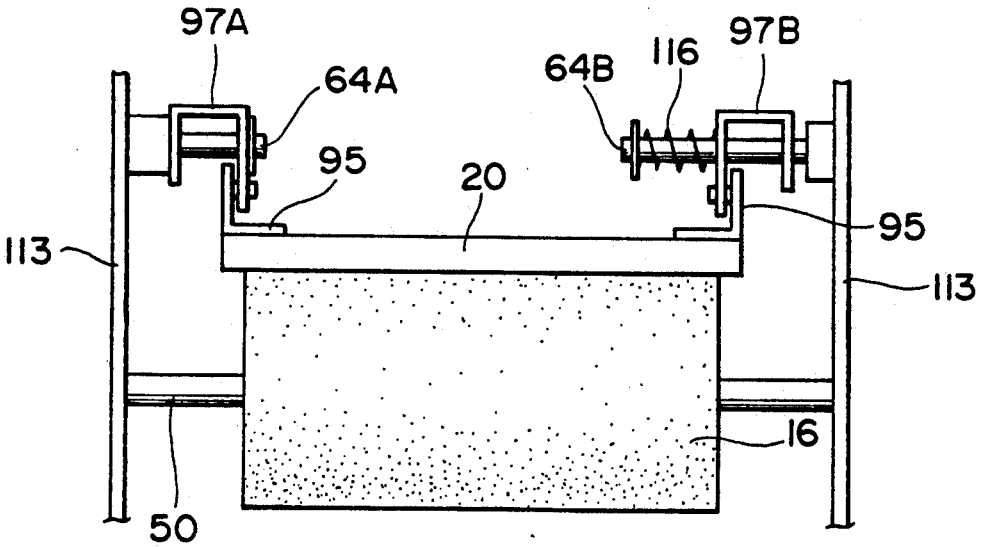
FIG. 12 is a front view of the thermal print head mounting structure shown in FIG. 11.

As shown in FIGS. 10 to 12, the base end portions of the oscillatory arms 97A, 97B are respectively supported through shafts 64A, 64B by a base plate 113. In other words, the base end portion of the oscillatory arm 97A is journaled through an E ring 114 on the shaft 64A and the oscillatory arm 97B is energized in the right direction in the figures by a spring 116. Therefore, the oscillatory arms 64A, 64B, to which the thermal print head 20 is connected, are energized in the right direction and the E ring 114 serves as a reference surface. This prevents the thermal print head 20 from shifting out of position.

As shown in FIG. 10, a seesaw lever 118 is supported by the side plate 120 in such a manner that the seesaw lever 118 can freely oscillate. In other words, a pin 122 provided projectingly on and from the central part of the seesaw lever 118 is loosely fitted into a circular hole 124 formed in the side plate 120, so that the seesaw lever 118 is free to oscillate about the central portion thereof. The lower ends of springs 126 are respectively mounted to the two ends of the seesaw lever 118, while the upper ends of the springs 126 are respectively mounted to the tip ends of levers 128. The levers 128 are respectively journaled through shafts 130 onto the base plate 113 and the base end portions of the levers 128 are respectively journaled through pins 132 on the first ends of levers 136. Also, normally, the lever 128 are abutted against a stopper 150 projecting from the base plate 113 to charge a spring force. The second ends of the levers 136 are respectively connected through common shafts 138 to the first ends of levers 140. The levers 140 are respectively journaled on the oscillatory arms 97A, 97B. Also, levers 141 are respectively journaled on the common shaft 138 and the second ends of the levers 141 are respectively journaled through pins 144 on the first ends of drive levers 142. The second ends of the drive levers 142, 142 are respectively fixed to a drive shaft 146.

The drive shaft 146 is connected to a motor (which is not shown) and, if the drive shaft 146 is rotated clockwise in FIG. 10, then the drive lever 142 is rotated clockwise to rotate the oscillatory arms 97A, 97B counter-clockwise through the levers 141, 140. As a result of this, the thermal print head 20 is brought into contact with the platen drum 16 and further, when the levers 128 are moved apart from the stopper 150, then the springs 126 pushes and energizes the thermal print head 20 through the levers 128, 136, 140. At this time, if the spring forces vary between the springs 126, then the seesaw lever 18 is inclined to pull the weaker spring more greatly than the stronger spring to thereby equalize the springs respectively applied to the levers 128. As a result of this, the thermal print head 20 can be energized toward the platen drum 16 with a uniform force.

On the other hand, if the drive shaft 146 is rotated counter-clockwise, then the drive lever 142 is rotated counter-clockwise and the levers 128 are abutted against the stopper 150. Thereafter, the thermal print head 20 is rotated clockwise and is thus moved apart from the platen drum 16.

A description will be given below of the operation of the embodiment of a thermal printer constructed in the above-mentioned manner according to the invention.

Figure 2:
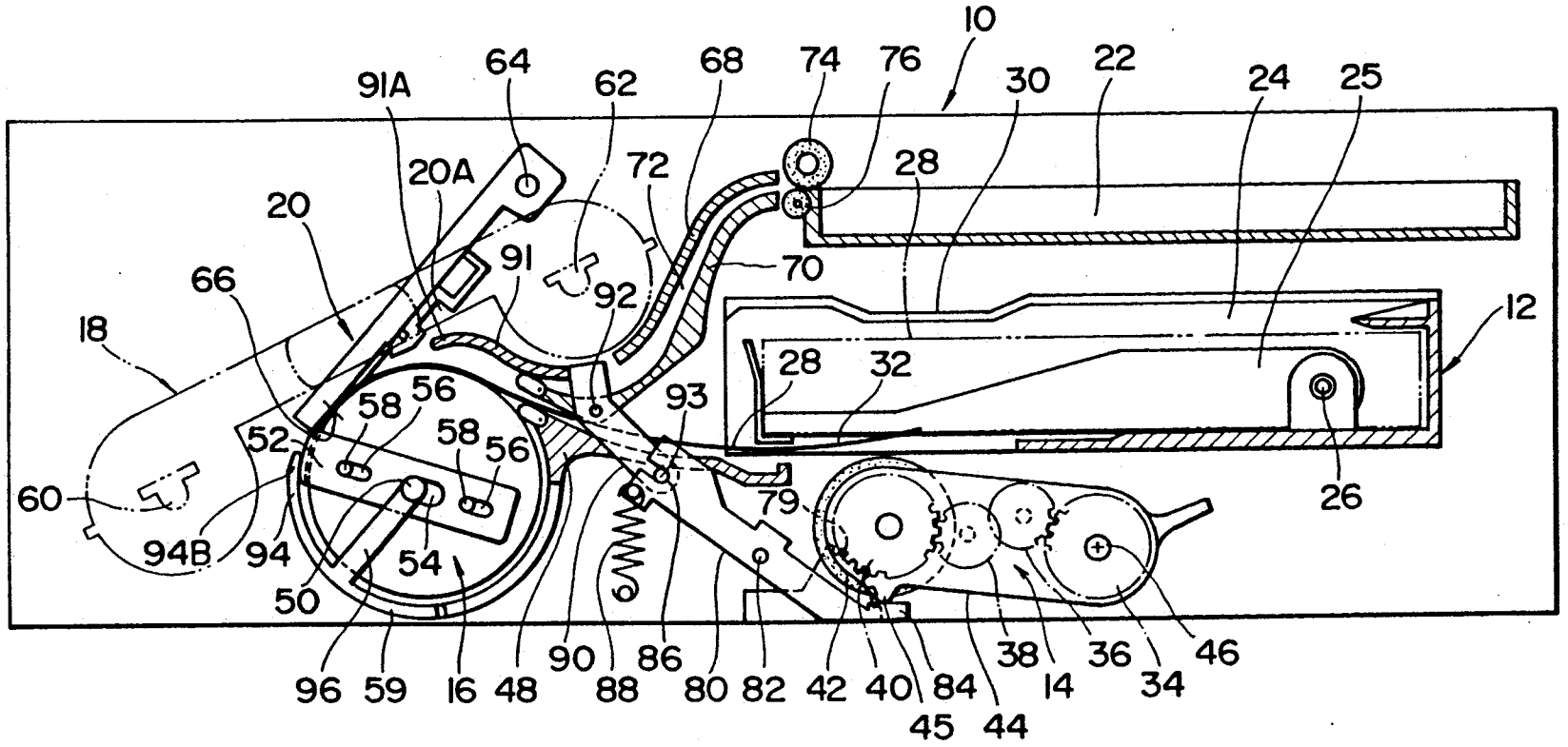
FIGS. 2 to an embodiment of 5 are respectively views of the operation of a thermal printer according to the invention.

At first, as shown in FIG. 1, the oscillatory arm unit 44 is rotated clockwise to push the recording paper peel-off member 25 and the piled-up sheets of recording paper 28 upwardly. The upper portion of the recording paper 28 is brought into contact with the receiving member 30 and, in this state, if the paper feed roller 42 is rotated counter-clockwise, the recording paper 28 is sent out sheet by sheet from the feed-out opening 32 by the paper feed roller 42. Then, the recording paper 28 is guided along the fixed paper guide 48 and is abutted against the stopper 52A of the clamper 52 of the platen drum 16 shown in FIG. 7. If the recording paper 28 is abutted against the stopper 52A of the clamper 52, then the clamper 52 is moved down in the diametrical direction to clamp the leading end of the recording paper 28. In this state, the platen drum 16 is rotated counter-clockwise and thereafter the thermal print head 20, as shown in FIG. 2, is oscillated counter clockwise and printing is started just after the recording paper 28 is clamped. At this time, the oscillatory arm unit 44 is oscillated counter-clockwise about the shaft 46, while the projection portion 45 of the oscillatory arm unit 44 is pressed against the flat portion 84 of the drive lever 80. If the projection portion 45 of the oscillatory arm unit 44 is pressed against the flat portion 84, then, as shown in FIG. 2, the drive lever 80 is rotated clockwise against the energizing force of the spring 88 and further the movable lever 90 is rotated counter-clockwise about the shaft 92 to thereby retreat the leading end 91A of the movable paper guide 91 from the ink sheet cassette 18

At the same time, the rotary paper guide 94 is rotated counter-clockwise to a position in which the lower end portion 94A thereof intersects the fixed paper guide 59 deeply. In this position, as shown in FIG. 2, the upper end portion 94B of the rotary paper guide 94 is retreated from the ink sheet cassette 18.

The image printing is started in the state shown in FIG. 2 and the platen drum 16 is rotated counter-clockwise.

In a thermal printer according to the present embodiment, due to the fact that the clamping position of the leading end of the recording paper the platen drum is set at a position just before the printing part and the image printing is started immediately after the leading end clamping position passes through the thermal print head 20, a time necessary from the feeding of the recording paper 28 to the printing start time can be shortened.

Figure 3:
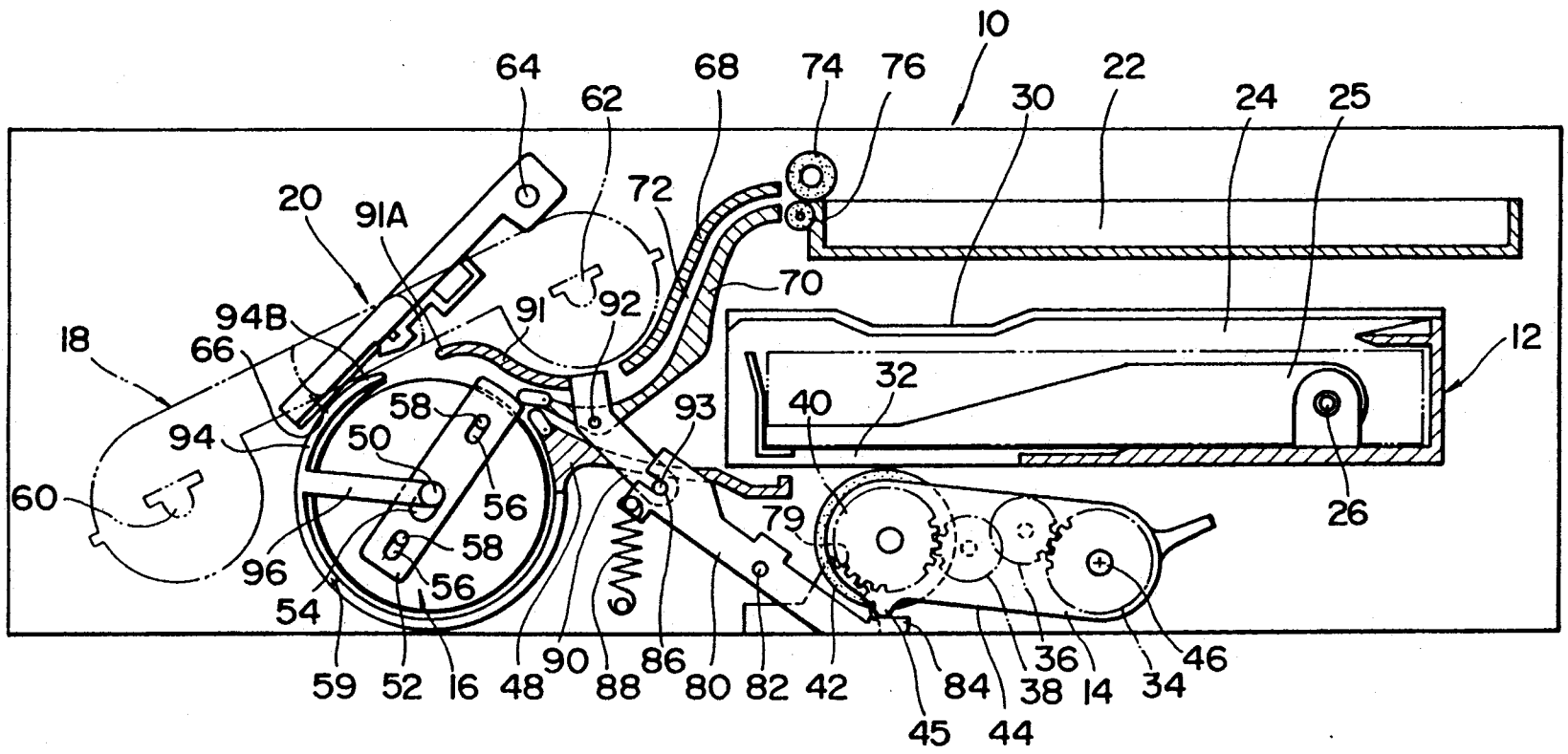
FIG. 3 is a view to show a state just before the recorded paper is discharged.

In the image printing on the platen drum 16, the printing conditions of Y, M, C are different from one another. In other words, for the Y printing, as shown in FIG. 2, the image is printed on the recording paper 28 in a state in which the recording paper 28 is not wound around the platen drum 16 and, for the M, C printing, as shown in FIG. 3, the image is printed on the recording paper 28 in a state in which the recording paper 28 is wound round the platen drum 16. For this reason, in order to establish the uniform printing condition, a pressure roller may be disposed in the paper feed passage in the Y printing to thereby apply loads such as a friction force or the like to the recording paper 28.

In the state shown in FIG. 2, if the platen drum 16 is rotated and the recording paper 28 is positioned in the openings in the paper feed passage 49 and paper discharge tray passage 72, then, as shown in FIG. 9 (A), the oscillatory piece members 98, 102 are pushed up and further, if the trailing end of the recording paper 28 is situated in the opening, then the oscillatory piece members 98, 102 close the opening, for thereby preventing the trailing end of the recording paper 28 from jumping up at the edge of the opening.

In the state shown in FIG. 2, if the platen drum 16 is rotated counter-clockwise, then the recording paper 28 is guided counter-clockwise as shown in FIG. 9 (A). When the trailing end of the recording paper 28 is going to pass through the connecting portion between the paper guide 48 and paper guide 59, as shown in FIG. 9 (A), the trailing end of the recording paper 28 is guided by the end portion 48A of the paper guide 48 and is thus moved apart from the end portion of the paper guide 59, for thereby preventing the trailing end of the recording paper 28 from jumping up in the connecting portion.

In the above embodiment, the present invention is applied to the connecting portion between the end portion 48A of the fixed paper guide 48 and the fixed paper guide 59. Alternatively, however, the present invention can also be applied to the connecting portion between the fixed paper guide 59 and the rotary paper guide 94.

As shown in FIG. 3, when the printing is completed and just before the paper is discharged, the thermal print head 20 is oscillated clockwise to retreat from the printing position and the oscillatory arm unit 44 is rotated clockwise about the shaft 46, whereby the drive lever 80 is rotated counter-clockwise by the energization force of the spring 88 to rotate the movable lever 90 clockwise about the shaft 92, for thereby inserting the leading end portion 91A of the movable paper guide 91 into the ink sheet cassette 18. At the same time, the rotary paper guide 94 is rotated clockwise and the upper end 94B of the rotary paper guide 94 is situated within the ink sheet cassette 18. In this state, the platen drum 16 is rotated reversely and the trailing end of the recording paper 28 is guided by the rotary paper guide 94 and movable paper guide 90 into the paper discharge passage 72, without being inserted into the ink sheet cassette 18 or into a recessed portion 20A in the thermal print head 20. The recording paper 28 guided to the paper discharge passage 72 is further guided to the paper discharge rollers 74, 76, when the clamping of the recording paper 28 by the clamper 52 is released. After then, the recording paper 28 is driven by the paper discharge rollers 74, 76 and is then stored into the paper discharge tray 22.

In the above-mentioned embodiment, the rotary paper guide mechanism and the movable paper guide mechanism are used in combination. Alternatively, however, if the amount of rotation of the rotary paper guide mechanism is increased, then it is possible to achieve a desired effect only by using the rotary paper guide mechanism.

As has been described heretofore, according to the thermal printer of the present invention, due to the fact that immediately after completion of the printing, the platen drum 16 can be rotated reversely to discharge the printed paper, it is possible to prevent the platen drum 16 from rotating wastefully and the printing time can be reduced.

Figure 13:
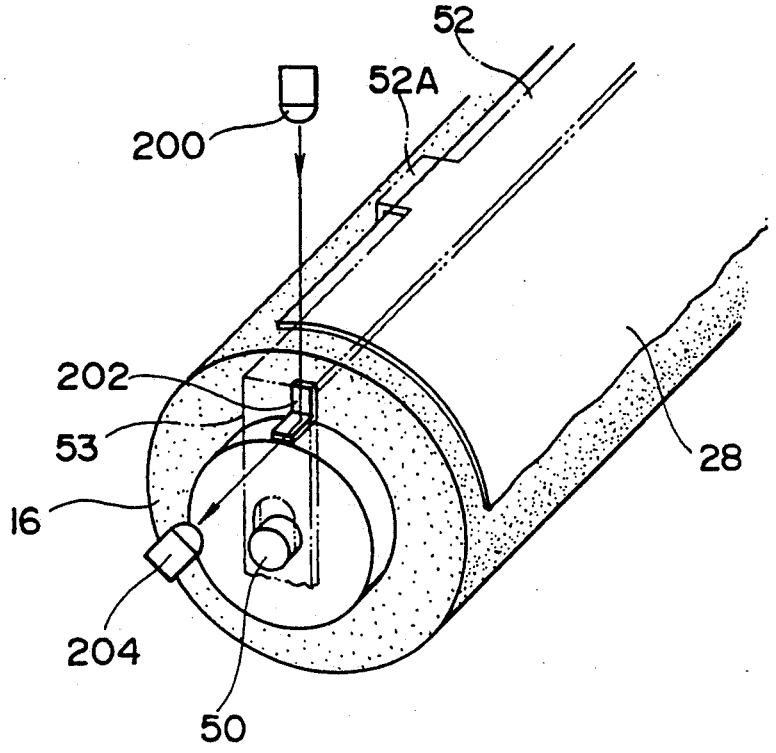
FIGS. 13 and 14 are respectively explanatory views of a structure for preventing an ink sheet cassette from rotating in a reverse direction.

Referring now to FIG. 13, there is shown a detector which is used to detect the recording paper. In particular, the light from a light emitting part 200 disposed above the platen drum 16 is turned about 90° by a mirror (or a prism) 202 provided in the platen drum 16 and then reaches a light receiving part 204 provided on the side portion of the platen drum 16. When the recording paper 28 is not fed, the detector is situated at a position to be able to detect the HP (home position) of the platen drum 16. When the recording paper 28 is fed and reaches the stopper 52A of the clamper 52, then the light receiving part 204 is shielded by the recording paper 28 from the light from the light emitting part 200, for thereby detecting the completion of the paper feeding.

In this manner, the HP as well as the paper feed completion can be detected by only one sensor, which results in the improved position accuracy.

Figure 14:
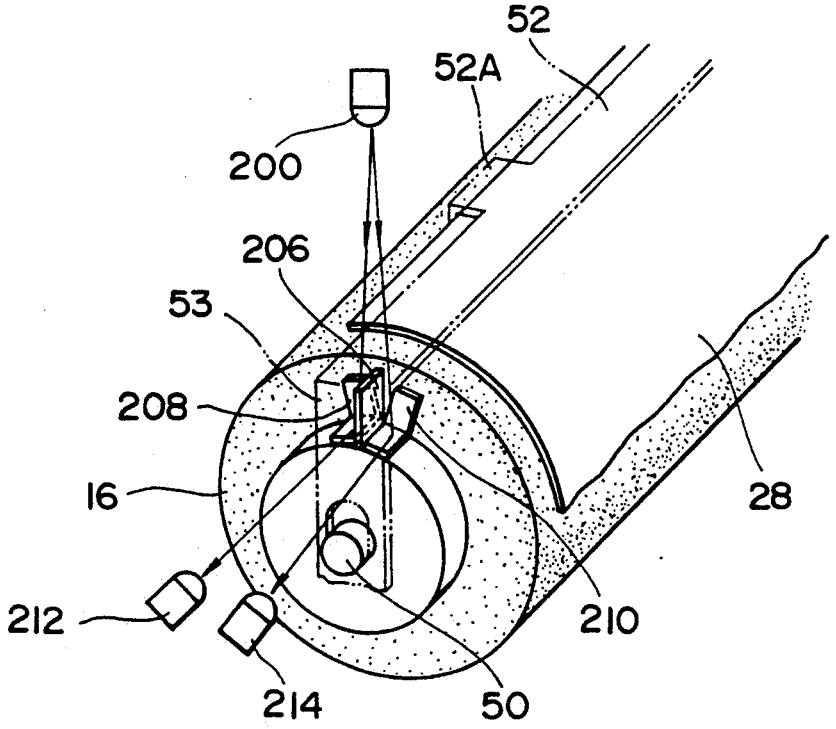

Referring now to FIG. 14, the light from the light emitting part 200 is applied to two mirrors 208, 210 by use of a partition plate 206 and these lights are then reflected onto a platen drum HP detect sensor 212 and a recording paper sensor 214. The platen drum HP detect and recording paper sensors 212 and 214 are disposed in such a manner that in the recording paper feed completion position the sensor 214 is shielded from the light while the sensor 212 is not shielded. Due to this, the following four positions can be detected:

| | | | | |
|---|---|---|---|---|
| Sensor 212 | O | O | X | X |
| Sensor 214 | O | X | O | X |
| State | Platen HP Position | Paper Feed Completion | Platen rotates forwardly and approaches its HP position | Recording paper is being conveyed |

O Light is received.
X Light is shielded.

Figure 15:
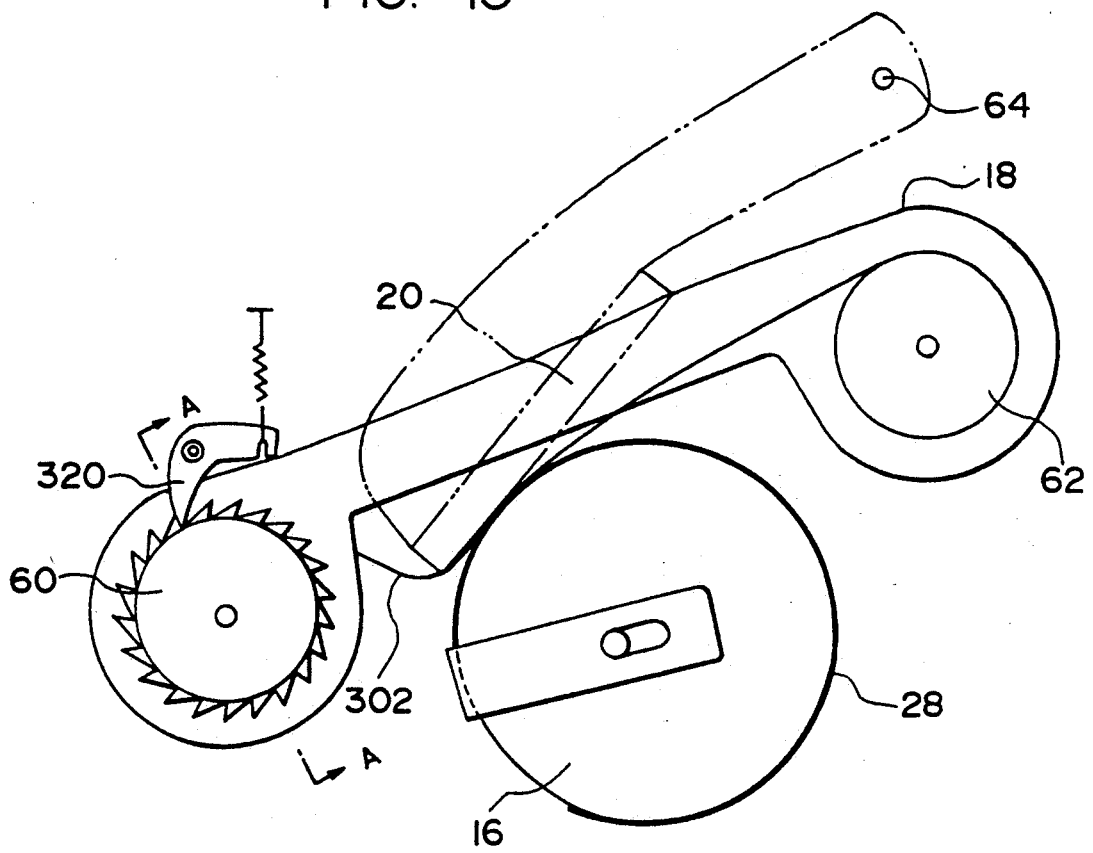
FIG. 15 is an explanatory view of a structure for preventing an ink sheet cassette from rotating in a reverse direction.
Figure 16:
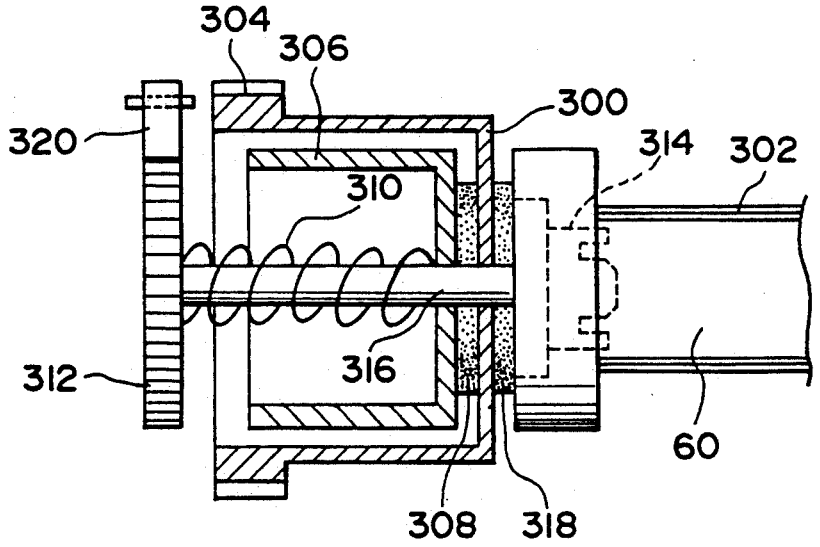
FIG. 16 is a section view of a structure of a take-up reel of an ink sheet cassette.
Figure 17:
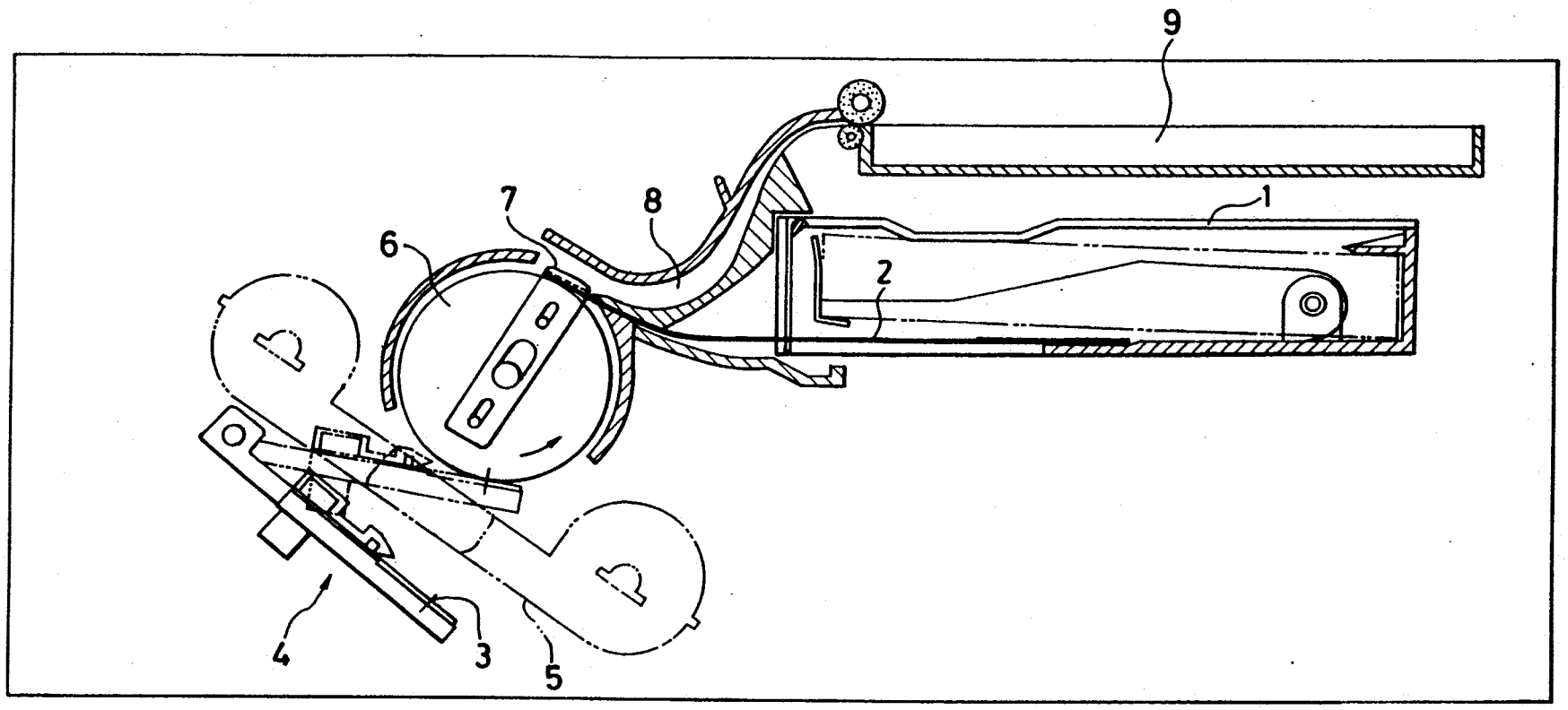
FIG. 17 is an explanatory view of a conventional thermal printer.

Referring now to FIGS. 15 and 16, there are shown the internal structures of the ink sheet cassette 18 and a take-up reel. A take-up hub 300 includes an end portion 314 engageable with a take-up shaft 60 around which an ink sheet 302 is to be wound. The take-up hub 300 is connected to a ratchet wheel 312 by a shaft 316. In the ratchet wheel 312 there is disposed a ratchet 320 in such a manner that the ratchet 320 is engageable with the ratchet wheel 312. The ratchet 320 does not engage with the ratchet wheel 312 when the take-up hub 300 is rotating in the winding direction, but the take-up hub 300 engages with the ratchet wheel 312 in the reversed rotation of the take-up hub 300 to thereby prevent the take-up hub 300 from rotating in the reverse direction On the other hand, on the contact surface of the take-up hub 300 and the contact surface between the take-up hub 300 and an inner cylinder 306, there are disposed felts 318, 308, respectively, and the inner cylinder 306 is energized by a spring 310 to press against the take-up hub 300. Also, the take-up hub 300 includes a take-up gear 304 which is connected to a drive motor through a gear transmission mechanism (not shown). If the take-up gear 304 is rotated in the winding direction by the drive motor, then the take-up hub 300 is rotated at a constant torque by the friction force of the felts 318, 308, so that the ink sheet 302 can be wound around the take-up shaft 60.

The ink sheet 302 is drawn out from the supply shaft 62 in the order of the Y, M, C regions. In this operation, even if the ink sheet 302 and the recording paper 28 are thermally fused and attached to each other to thereby produce a possibility of rotating the take-up shaft 60 in the reversed direction due to conveying of the recording paper 28, the ink sheet 302 can never be fed reversely because the take-up shaft 60 is locked by the ratchet 320.

As has been described heretofore, in the thermal printer of the present invention, even if the ink sheet and recording paper 28 are attached to each other by thermal fusion 302, the reversal preventive mechanism prevents the ink sheet 302 from being fed in the reversed direction, so that it is possible to prevent jamming or the like of the ink sheet.

Although the above-mentioned embodiment description has been given for the thermal printer of a heat transfer type, the present invention can also apply to a thermal printer of a heat sensitive type.

According to the above-mentioned embodiment, there is used an ordinary ink sheet for color printing in which three colors, that is, yellow, magenta and cyan are formed sequentially in the different regions thereof. According to the invention, alternatively, an ink sheet for photo-engraving can also be used which is formed by coating a single color of ink thereon. When using such an ink sheet with a single color of ink, a superimposing signal of YMC may be applied to the thermal print head to execute printing once by use of the single color ink sheet.

It should be understood, however, that there is no intention to limit the invention to the specific forms disclosed, but on the contrary, the invention is to cover all modifications, alternate constructions and equivalents falling within the spirit and scope of the invention as expressed in the appended claims.

We claim:

1. A thermal printer comprising:

a recording paper storage part for storing a plurality of sheets of recording paper respectively cut to a given length and piled on one another;

recording paper feed-out means for feeding out said recording paper sheet by sheet from said recording paper storage part;

a platen drum for winding said recording paper fed out by said recording paper feed-out means around a peripheral surface of said platen drum;

clamp means for clamping a leading end of said recording paper to said platen drum;

a thermal print head having a printing position being set just behind a clamp starting position of said clamp means for printing an image onto said recording paper disposed on said platen drum while said platen drum is rotating; and a paper discharge tray part for receiving said recording paper conveyed through a discharge passage way which has the entrance of said discharge passage way located just near the down stream of said thermal print head by said platen drum when said platen drum is rotated after completion of printing said image onto said recording paper.

2. A thermal printer as set forth in claim 1, further comprising oscillatory arm located at a paper feed position, wherein said recording paper feed-out means includes a paper feed roller supported at a tip end of said oscillatory arm means, and wherein said paper feed roller is in contact with said recording paper in a paper feed mode in a feed-out opening formed in said recording paper storage part and also at a paper non-feed position and said paper feed roller is kept away from said recording paper storage part in a paper non-feed mode, and said oscillatory arm means can be secured by a securing member at said paper non-feed position in said paper non-feed mode.

3. A thermal printer as set forth in claim 1, wherein said thermal print head includes hold portions located at first and second sides thereof and said thermal print head is slightly movably supported at the hold portions in a recording paper conveying direction and in a direction perpendicular to said recording paper conveying direction and also said thermal print head is positioned in such a manner that said thermal print head can be moved in an axial direction of said platen drum, said thermal print head being energized in one side by a spring member.

4. A thermal printer as set forth in claim 1, further comprising sensor means including a light emitting part for emitting light toward said platen drum, reflecting means disposed on said platen drum for reflecting said light from said light emitting part, a light receiving part for receiving said light reflected by said reflecting means outside said platen drum, and wherein said light emitting part, said reflecting means and said light receiving part respectively are located at a position where said light from said light emitting part can be shielded by said recording paper at a clamp position of said recording paper on said platen drum and are also located at a position where a home position of said platen drum can be detected before said recording paper arrives at said clamp position on said platen drum.

5. A thermal printer as set forth in claim 1, comprising:

an ink sheet cassette including an ink sheet supply shaft and an ink sheet take-up shaft;

an ink sheet supply reel engageable with said ink sheet supply shaft;

an ink sheet take-up reel engageable with said ink sheet take-up shaft; and a reversal preventive mechanism disposed on said ink sheet take-up reel.

6. A thermal printer comprising:

a recording storage part for storing a plurality of sheets of recording paper respectively cut to a given length and piled on one another;

recording paper feed-out means for feeding out said recording paper sheet by sheet from said recording paper storage part;

a platen drum for holding a leading end of said recording paper fed out by said recording paper feed-out means and winding said recording paper around a peripheral surface of said platen drum;

a thermal print head for printing an image onto said recording paper disposed on said platen drum while said platen drum is rotating;

a paper discharge tray part for receiving said recording paper conveyed thereto by said platen drum when said platen drum is rotated after completion of printing of said image; and rotary paper guide means constructed so as to be rotatable around said platen drum for guiding a trailing end of said recording paper to a paper discharge passage at the completion of printing of said image.

7. A thermal printer as set forth in claim 6, further comprising movable paper guide means linked with said recording paper feed-out means for moving by operating of said recording paper feed-out means, an end portion of said movable paper guide means is retreated from an ink sheet cassette during printing, and when said recording paper is discharged after completion of printing of said image, the end portion of said movable paper guide means is inserted into said ink sheet cassette to thereby prevent the trailing end of said recording paper from entering said ink sheet cassette.

8. A thermal printer comprising:

a recording paper storage part for storing a plurality of sheets of recording paper respectively cut to a given length and piled on one another;

recording paper feed-out means for feeding out said recording paper sheet by sheet from said recording paper storage part;

a platen drum for holding a leading end of said recording paper fed out by said recording paper feed-out means and winding said recording paper around a peripheral surface of said platen drum;

a thermal print head for printing an image onto said recording paper on said platen drum while said platen drum is rotating;

a paper discharge tray part for receiving said recording paper conveyed thereto by said platen drum when said platen drum is rotated after completion of printing of said image; and a paper feed and discharge passage having an opening formed in a paper guide around said platen drum with an oscillatory piece member which is free to oscillate, for closing said opening, and when said recording paper is conveyed by said platen drum, said oscillatory piece member closes said opening in said paper feed and discharge passage to thereby guide said recording paper.

9. A thermal printer comprising:

a recording paper storage part for storing a plurality of sheets of recording paper respectively cut to a given length and piled on one another;

recording paper feed-out means for feeding out said recording paper sheet by sheet from said recording paper storage part;

a platen drum for winding said recording paper fed out by said recording paper feed-out means around a peripheral surface of said platen drum;

a thermal print head for printing an image onto said recording paper on said platen drum while said platen drum is rotating;

a paper discharge tray part for receiving said recording paper conveyed thereto by said platen drum when said platen drum is rotated after completion of printing of said image; and a plurality of paper guides, which are disposed around said platen drum and spaced at a given distance from said platen drum, having connecting portions and each of said plurality of paper guides are connected to one another by a respective one of said connecting portions and a forward end of at least one set of said connecting portions in a direction in which said recording paper is conveyed by said platen drum is positioned nearer to said platen drum than a trailing end thereof in the direction in which said recording paper is conveyed by said platen drum.

10. A method for printing an image by a thermal printer, comprising the steps of:

(a) storing a plurality of sheets of recording paper in a recording paper storage part which have been cut to a given length and piled on one another;

(b) feeding out said recording paper sheet by sheet from said recording paper storage part;

(c) winding said recording paper fed out at said step (b) around a peripheral surface of a platen drum;

(d) clamping a leading end of said recording paper to said platen drum by clamp means;

(e) setting a thermal print head just behind a clamp starting position of said clamp means;

(f) printing the image onto said recording paper disposed on said platen drum while said platen drum is rotating by said thermal print head; and (g) receiving said recording paper in a paper discharge tray through a discharge passage way which has the entrance of said discharge passage way located just near the down stream side of said thermal print head by rotating said platen drum after completion of said step (f).

11. A method as set forth in claim 10, further comprising the step of (h) detecting a home position of said platen drum before said recording paper arrives at a clamp position of said recording paper on said platen drum, said step (h) including the steps of, emitting light toward said platen drum by a light emitting part, receiving said light reflected by said reflecting means outside said platen drum by a light receiving part, said light emitting part, said reflecting means and said light receiving part being respectively located at a position where said light from said light emitting part can be shielded by said recording paper at said clamp position.

12. A method for printing an image by a thermal printer, comprising the steps of:

(a) storing a plurality of sheets of recording paper in a recording paper storage part which have been cut to a given length and piled on one another;

(b) feeding out said recording paper sheet by sheet from said recording storage part by recording paper feed-out means;

(c) holding a leading end of said recording paper fed out at said step (b) onto a platen drum;

(d) winding said recording paper around a peripheral surface of said platen drum;

(e) printing the image onto said recording paper disposed on said platen drum by a thermal print head while said platen drum is rotating;

(f) receiving said recording paper in a paper discharge tray by rotating said platen drum after completion of said step (e); and (g) guiding a trailing end of said recording paper to a paper discharge passage by rotary paper guide means, which rotate around said platen drum, at the completion of said step (e).

13. A method as set forth in claim 12, further comprising the steps of:

(h) moving movable paper guide means linked with said recording paper feed-out means in response to the operation of said recording paper feed-out means;

(i) retreating an end portion of said movable paper guide means from an ink sheet cassette during printing of said image; and (j) inserting the end portion of said movable paper guide means into said ink sheet cassette when said recording paper is discharged after completion of printing of said image so that the trailing end of said recording paper is prevented from entering said ink sheet cassette.

14. A method for printing an image by a thermal printer, comprising the steps of:

(a) storing a plurality of sheets of recording paper in a recording paper storage part which have been cut to a given length and piled on one another;

(b) feeding out said recording paper sheet by sheet from said recording paper storage part;

(c) holding a leading end of said recording paper fed out at said step (b) onto a platen drum;

(d) winding said recording paper around a peripheral surface of said platen drum;

(e) printing the image onto said recording paper on said platen drum while said platen drum is rotating;

(f) receiving said recording paper in a paper discharge tray by rotating said platen drum after completion of said step (e); and (g) closing an opening in a paper feed and discharge passing formed in a paper guide around said platen drum with an oscillatory piece member, which is free to oscillate, and when said opening in said paper feed and discharge passage by said oscillatory piece member to guide said recording paper.

15. A method for printing an image by a thermal printer, comprising the steps of:

(a) storing a plurality of sheets of recording paper in a recording paper storage part which have been cut to a given length and piled on one another;

(b) feeding out said recording paper sheet by sheet from said recording paper storage part;

(c) winding said recording paper fed out at said step (b) around a peripheral surface of a platen drum;

(d) printing the image onto said recording paper on said platen drum while said platen drum is rotating;

(e) receiving said recording paper in a paper discharge tray by rotating said platen drum after completion of said step (d); and (f) connecting a plurality of paper guides, which are disposed around said platen drum and spaced at a given distance from said platen drum, having connecting portions for connecting each of said plurality of paper guides to one another by a respective one of said connecting portions and a forward end of at least one set of said connecting portions in a direction in which said recording paper is conveyed by said platen drum is positioned nearer to said platen drum than a trailing end thereof in the direction in which said recording paper is conveyed by said platen drum.

* * * * *